United States Patent [19]

Mizelle

[11] Patent Number: 4,559,654

[45] Date of Patent: Dec. 24, 1985

[54] BEDDING UNITS AND COMPONENTS FOR SUCH UNITS

[76] Inventor: Ned W. Mizelle, 230C N. Point Ave., High Point, N.C. 27260

[21] Appl. No.: 532,137

[22] Filed: Sep. 14, 1983

[51] Int. Cl.[4] ..... A47C 23/02; A47C 23/053

[52] U.S. Cl. ..... 5/255; 5/247; 5/253; 5/261

[58] Field of Search ..... 5/246, 247, 253, 255, 5/259 R, 260, 261, 262, 264 R, 264 B, 268, 267; 267/103, 107

[56] References Cited

U.S. PATENT DOCUMENTS

| | | | |
|---|---|---|---|
| 2,475,765 | 2/1947 | Schmidt | 5/246 |
| 2,886,311 | 5/1959 | Flint | 267/107 |
| 3,574,241 | 4/1971 | Slominski | 5/255 |
| 3,653,081 | 4/1972 | Davis | 5/262 |
| 3,720,960 | 3/1973 | Bond | 5/259 R |
| 3,825,960 | 7/1974 | Inman et al. | 5/247 |
| 4,069,525 | 1/1978 | Valoff | 5/255 |
| 4,238,861 | 12/1980 | Mizelle | 5/255 |
| 4,452,438 | 6/1984 | Hancock et al. | 5/255 |
| 4,470,584 | 9/1984 | Mizelle | 267/103 |

*Primary Examiner*—Gary L. Smith
*Assistant Examiner*—Michael F. Trettel
*Attorney, Agent, or Firm*—Beveridge, DeGrandi & Weilacher

[57] ABSTRACT

A bedding unit utilizes formed wire springs for supporting a wire grid on a frame. A spring has an upper portion which has two transverse bars, a longitudinal center bar located between and spaced from the transverse bars, and connecting sections which connect the opposite ends of the center bar to the ends of the transverse bars. Under compression, the upper portion of the spring or a grid wire attached thereto contacts a torsion bar in the spring. Some embodiments have a continuous and uninterrupted lower portion and an upper portion with two sections which terminate in the ends of the spring wire.

A limited deflection corner spring has an upper attachment bar, two upper connector bars which diverge downwardly from opposite ends of the attachment bar, two perpendicular upper torsion bars which extend inwardly from the lower ends of the upper connector bars, two inclined lower connector bars which extend downwardly from the inner ends of the upper torsion bars, and two perpendicular nonrotatable lower torsion bars which extend outwardly from the lower ends of the lower connector bars.

A stop member for limiting downward movement of the wire grid assembly is an integral piece which has a vertical loop connected to a plurality of angularly disposed spaced bars which are located in a horizontal plane.

53 Claims, 23 Drawing Figures

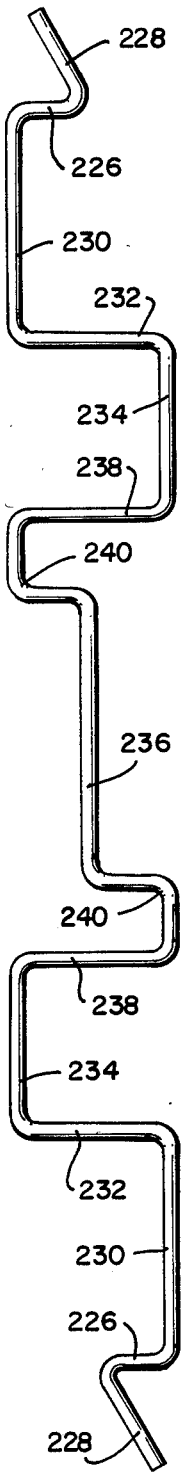
FIG 15
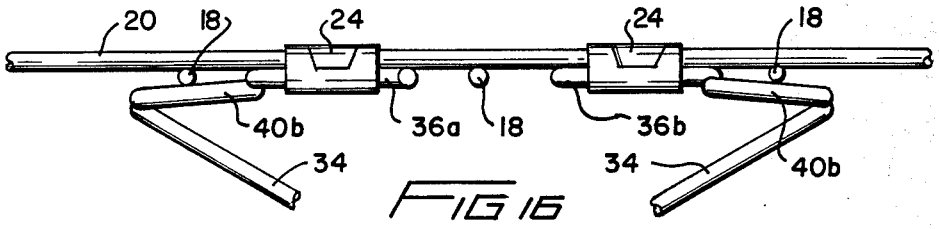
FIG 16
FIG 18
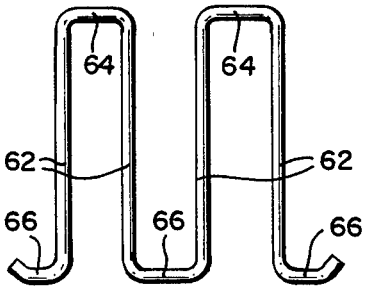
FIG 21
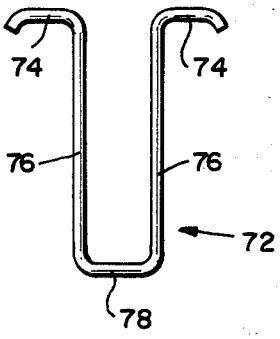
FIG 19
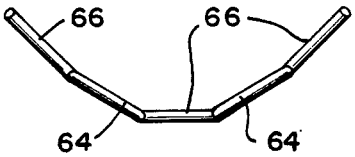
FIG 22
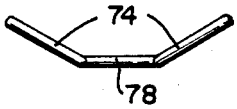
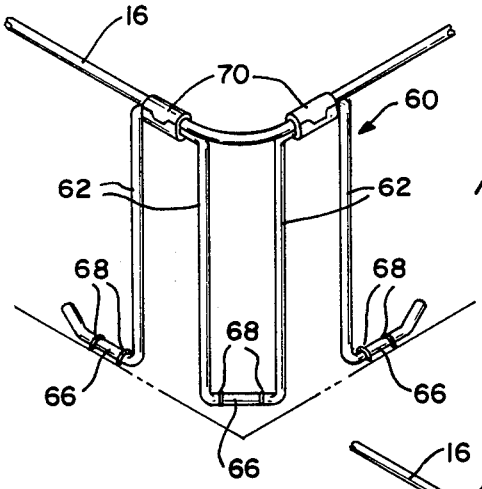
FIG 17
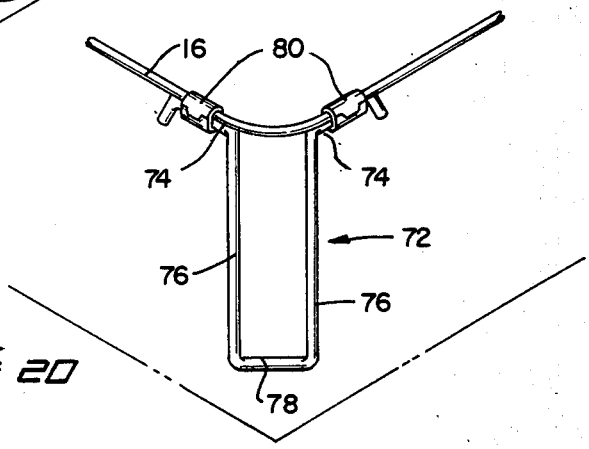
FIG 20

BEDDING UNITS AND COMPONENTS FOR SUCH UNITS

BACKGROUND OF THE INVENTION

This invention relates to bedding units and to springs and other components used in such units.

Traditionally, box spring units have been manufactured of many helical coil springs which support an upper deck on a lower frame member. In recent years, some segments of the industry have moved to a more modern construction which utilizes, in lieu of coil springs, nonspiral formed wire springs provided with horizontal torsion bars which have their opposite ends connected to upwardly and downwardly inclined connector bars. Many examples of bedding units with formed wire springs are classified according to the U.S. Classification System in Class 5, Subclasses 247 and 255.

Although bedding units with formed wire springs have performed satisfactorily to the extent that they now occupy a large proportion of the box spring production in this country, the present invention represents significant improvements in this field.

In one respect, the spring disclosed in this specification has particular advantages relating to the manner in which its upper end attaches to and supports a wire grid which forms the mattress supporting deck of the unit. In this regard, the upper portion of the spring provides excellent coverage so that the spring effectively supports a relatively large span and area of the wire grid. Furthermore, the upper portion of the spring has a novel configuration which permits its attachment to many different locations on a wire grid, making it possible to change distances between adjacent springs without changing the spacing between the grid wires.

By utilizing the principles of this invention, it is possible to reduce the number of springs and the total amount of spring wire required to provide effective support of a wire grid of any given size.

From a performance standpoint, the bedding units disclosed in this specification are believed to have a lower susceptibility to damage when they are subjected to extreme forces and impacts. The springs have two vertically collapsible columns which are located reasonably close to each other to avoid overloading of one column and to ensure that shock forces imposed on the springs will be shared by both columns. The lower portion or base of the spring is preferably constructed to provide a stable platform which requires a minimum number of staples or other fasteners to connect it to the frame of the bedding unit.

The disclosed apparatus is also desirable due to the particular arrangements whereby the springs are limited deflection springs, i.e. springs which are deflectable only a predetermined distance. Utilizing the novel configurations of the invention, the deflection of a spring stops when a torsion bar in its midportion is contacted by a grid wire or by the upper attachment portion of the spring body.

The invention also involves a novel corner spring which is effective due to its utilization of a torsion bar principle. The corner spring preferably has limited deflection characteristics.

In another respect, the invention involves improvements based on the utilization of simple and inexpensive pieces which are attached to the wire grid to limit its downward movement, preferably at the corners of the unit where the pieces also serve to prevent inward sagging of the filling material of the unit.

Furthermore, the invention includes a novel arrangement for clipping the spring to a wire grid of a bedding unit, wherein a yieldable plastic material is coated on the interior of an attachment clip to avoid the necessity of coating the springs and/or the grid wires which are clipped together.

Finally, the invention is directed to a construction which permits the utilization of a relatively lightweight wire grid, and a minimum amount of spring wire, staples and attachment clips. Other attributes of the invention may be seen from the accompanying description of a few embodiments of the invention.

SUMMARY OF THE INVENTION

This invention relates primarily to improvements in springs and in bedding units which utilize such springs to support a wire grid on a frame. Each spring is formed of a single resilient wire which has a lower portion connected to the frame, a substantially horizontal upper portion connected to the wire grid, and a vertically collapsible midportion which resiliently supports the upper portion on the midportion.

Preferably, the frame includes a plurality of parallel cross rails extending from side-to-side of the bedding unit. The wire grid is formed of a plurality of longwires intersecting a plurality of crosswires which lie in vertical alignment with the crossrails of the frame. The crosswires extend over the longwires, and they have a greater diameter and greater stiffness than the longwires. The spring preferably is a formed wire spring which has its midportion formed of interconnected torsion bars and connector bars.

One feature of the invention is that the spring has an upper portion which includes a longitudinal center bar, a pair of transverse bars and a pair of connecting sections. The center bar is located between and spaced from the transverse bars, and its opposite ends are directed toward midportions of the transverse bars. The connecting sections each extend from one end of the center bar to one end of a transverse bar. Preferably, the center bar is connected to a crosswire of a wire grid.

Another feature of the invention is that a bedding unit of the type described has at least one spring which has an upper portion formed of the following components: a transverse bar, a longitudinally oriented center bar which is spaced from the transverse bar at a position where the axis of the center bar is directed toward the midportion of the transverse bar, and a connecting section which extends from one end of the center bar to one end of the transverse bar.

Preferably, in the spring described in the preceding paragraphs of this summary, the transverse bars are torsion bars, the midportion is provided with torsion bars and connector bars, and the connector bars connect the torsion bars of the midportion to the lower portion and to the transverse torsion bars of the upper portion. Each transverse bar and its associated connecting section form a hook-shaped configuration. The connecting section is L-shaped and includes a longitudinal bar which is positionable in underlying relation to a wire of the grid.

From another perspective, the invention relates to improvements in bedding units wherein each spring has its midportion formed of two vertically collapsible portions which extend downwardly to the lower portion from opposite ends of the upper portion. The improvement in such structures is that the single resilient wire has its opposite ends located in the upper portion of the spring, and the lower portion of the spring is continuous and uninterrupted so that each of its ends extends to one of the vertically collapsible portions.

The invention also relates to a bedding unit in which a novel principle is used to limit the deflection of the spring. The midportion of a spring includes a torsion bar and at least two connector bars which are connected to the torsion bar. The upper portion of the spring and the grid attached thereto are normally higher than the torsion bar but, when the midportion of the spring is collapsed, either the grid or the upper portion of the spring contacts the torsion bar to limit the deflection of the spring.

In some embodiments, the center bar is continuous and unbroken, and the lower portion is formed of two sections which are at opposite ends of the wire. The center bar lies in a vertical plane which intersects the torsion bars of the midportion, and the midportion of the spring is collapsible to a compressed position where the center bar contacts a torsion bar of the midportion to limit the deflection of the spring. In other embodiments of the invention, the center bar is formed of two sections which are at opposite ends of the spring wire, and the lower portion is a continuous and uninterrupted lower bar which extends between two connector bars of the midportion.

The invention also relates to a bedding unit which utilizes a novel corner spring. In this respect, the corner spring is formed of a single resilient wire which has an upper attachment portion connected to a corner of the wire grid. A pair of inclined upper connector bars extend downwardly in diverging directions from opposite ends of the attachment portion; and, a pair of upper torsion bars each have an end extending to the lower end of one of the upper connector bars. A pair of inclined lower connector bars each have an upper end extending to an end of one of the upper torsion bars. A pair of lower torsion bars each have an end nonrotatably mounted on the frame and extending to the lower end of one of the lower connector bars. The corner spring is vertically collapsible to support the corner of the grid on the frame. Preferably, the upper connector bars have a greater inclination from the horizontal than the lower connector bars, and the spring is deformable to a position where the upper torsion bars contact the frame to limit the deflection of the corner spring.

In another respect, the invention relates to a bedding unit which utilizes a stop member for limiting the movement of a grid assembly toward a frame assembly. The stop member has, at one end thereof, a plurality of horizontal bars which are connected to one of the assemblies. These horizontal bars lie in a common horizontal plane where they are spaced apart and angularly disposed relative to each other. A vertical loop has its opposite ends extending to two of the horizontal bars. This loop is substantially uncompressible in a vertical direction so it will limit the movement of the grid assembly toward the frame assembly. Such movement may be limited to zero movement by attaching the stop member to both the grid and frame assemblies: or, it may be limited to a predetermined amount by connecting the loop to one of the assemblies and positioning it where it is spaced from and movable toward the other assembly. Preferably, the horizontal bars of the stop member are connected to a corner of the grid assembly of a bedding unit.

The invention also involves a bedding unit in which a clip, provided with an internal coating of yieldable plastic material, is wrapped around a grid wire and the upper portion of a spring. This reduces the noise in the bedding unit. The coating preferably has a high coefficient of friction which deters lengthwise slipping movement of the wires which are clipped together.

Various other aspects of the invention will be evident from a study of the accompanying drawings and detailed description thereof.

BRIEF DESCRIPTION OF THE DRAWINGS

FIG. 16 is a side view which illustrates the relationship between the upper portion of a main spring and the wires of the wire grid.

FIG. 17 is a perspective view of a stop member located at the corner of a bedding unit, wherein the stop member is connected both to the wire grid and to the frame so that the vertical movement between these components will be limited to zero movement.

FIGS. 18 and 19 are front and top views, respectively, of the stop member shown in FIG. 17.

FIG. 20 is a perspective view of a stop member which is attached to a corner of the wire grid but is spaced above the frame to allow for a predetermined amount of movement between the wire grid and the frame.

FIGS. 21 and 22 are front and top views, respectively, of the stop member shown in FIG. 20.

DETAILED DESCRIPTION

Figure 1:
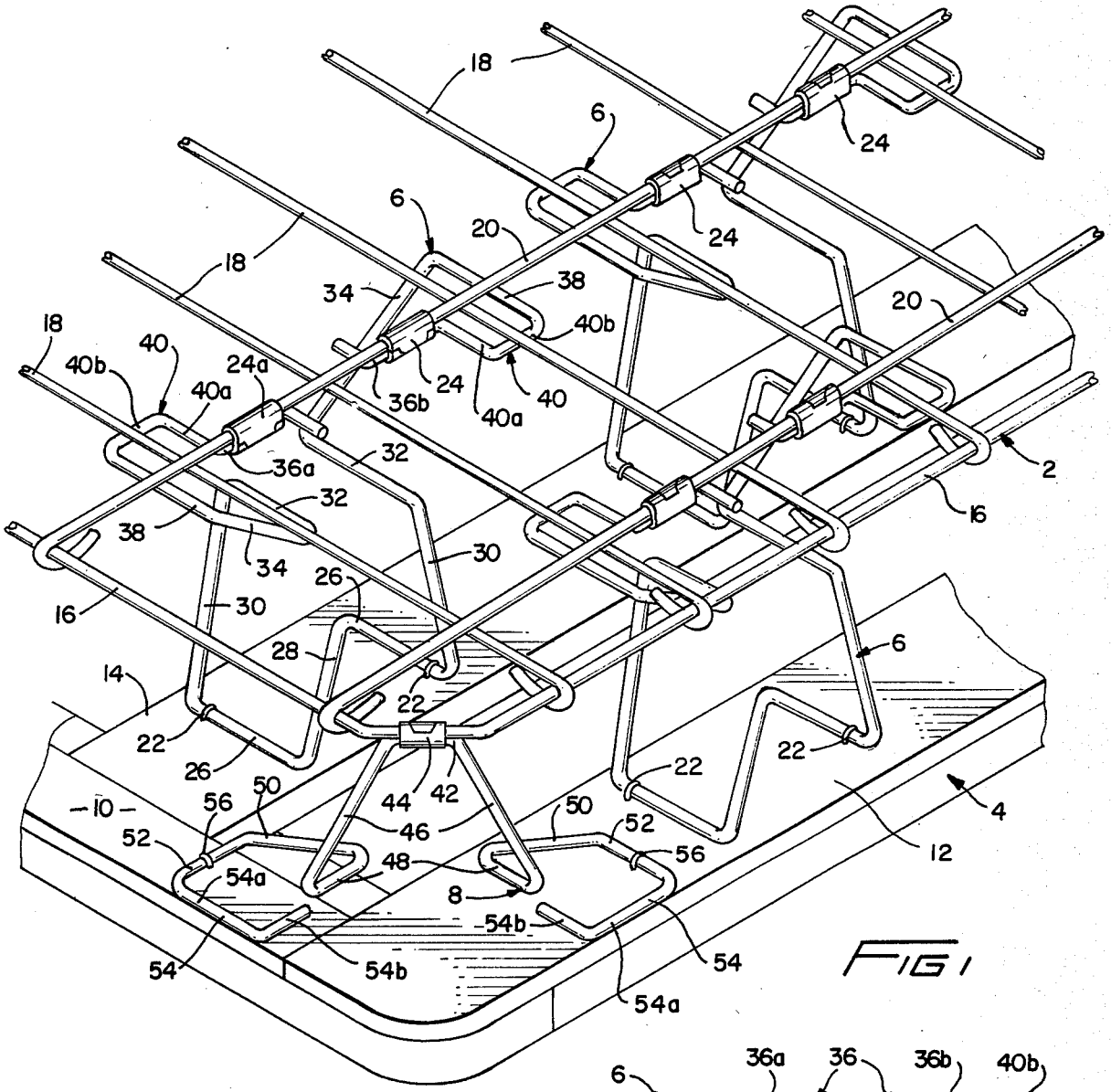
FIG. 1 is a perspective view showing a corner portion of a bedding unit constructed according to the invention, utilizing a corner spring and a plurality of main springs.

As shown in FIG. 1, the bedding unit is provided with a wire grid 2 which is resiliently supported on a frame 4 by a plurality of main springs 6 and a corner spring 8.

In accordance with conventional practice, the frame 4 is a rectangular wooden framework formed of side rails 10, end rails 12, and a plurality of parallel cross rails 14 which extend from side-to-side of the frame. For illustrative clarity, FIG. 1 shows only one side rail, one end rail and one cross rail. The cross rail is shown much closer to the end rail than in an actual bedding unit.

The grid 2 is formed of a heavy border wire 16 which corresponds in size and shape to the frame, a plurality of parallel longwires 18 which are bent around the border wire 16 and extend lengthwise of the unit, and a plurality of parallel crosswires 20 which extend from side-to-side of the unit and have their ends bent around the border wire. Each crosswire 20 is vertically aligned with one of the end rails 12 or cross rails 14 of the frame. The longwires and crosswires are welded together at their intersections. For efficacy and economy, the crosswires preferably have a greater diameter and are stiffer than the longwires, and they extend over rather than under the longwires. Since the grid wires do not act as springs, they are preferably formed of basic carbon steel wire rather than the more expensive spring wire.

Each of the main springs 6 has a lower portion or base which rests on a rail of the frame and is connected thereto by a pair of staples 22. The upper portion of the spring is attached by a pair of clips 24 to a crosswire of the grid, and the midportion of the spring is vertically collapsible to support the upper portion resiliently on the base.

Figure 2:
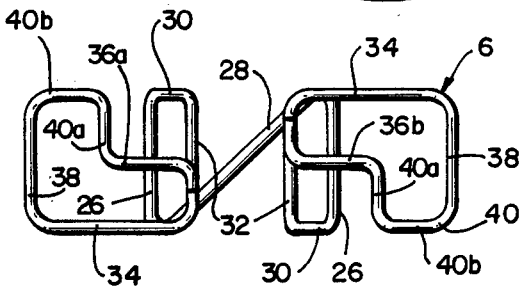
FIG. 2 is a top view of one of the main springs used in the embodiment of FIG. 1.
Figure 3:
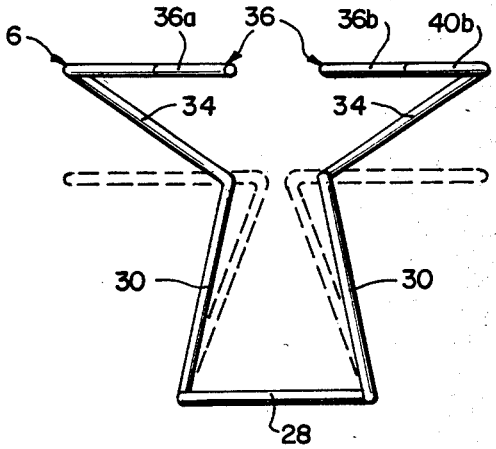
FIG. 3 is a front view of the spring of FIG. 2, showing its fully deflected position in broken lines.

The lower portion of the spring shown in FIGS. 1–3 has a Z-shape formed by a pair of transverse bars 26 which are connected together by a diagonal crossbar 28. The midportion of the spring has two vertically collapsible columns which extend downwardly from opposite ends of the upper portion to the lower portion of the spring. These two collapsible portions are oppositely oriented and substantially identical. Each includes a lower connector bar 30, a torsion bar 32 and an upper connector bar 34. The lower connector bars 30 are inclined inwardly in opposite directions from the opposite ends of the Z-shaped base. Each torsion bar 32 extends horizontally from an upper end of one of the lower connector bars; and, each upper connector bar 34 is inclined and extends outwardly from an end of one of the torsion bars 32. The upper end of each connector bar 34 is connected to one end of the upper portion of the spring.

The terms "longitudinal" and "transverse" are used in this specification to describe various elements of the springs. It is to be understood that these terms are used only to establish frames of reference, not to indicate how the elements are positioned relative to the bedding unit itself. In fact, at the preferred orientation shown in FIG. 1, the longitudinal direction of the spring 6 extends transversely or sideways to the bedding unit.

The upper portion of the spring has a longitudinally oriented center bar 36, a pair of transverse bars 38, and connecting sections 40 which extend from one end of the center bar 36 to one end of a transverse bar 38. The center bar 36 is formed of two axially aligned straight wire sections **36*a* and 36*b* which are spaced from each other. Each of these sections is formed integrally with only one of the connecting wire sections 40. As shown in FIG. 2, the opposite ends of the center bar are directed toward the midportions of the transverse bars 38, i.e. toward the middle one-third of the lengths of the transverse bars 38. Each of the center portions 36*a* and 36*b* is attached by a clip 24 to a crosswire 20 of the grid 2. Each connecting section 40 is L-shaped and is formed of a transverse leg 40*a* and a longitudinal leg 40*b*. Each longitudinal leg 40*b* has an outer end which extends to one end of the transverse bar; and, each transverse leg 40*a* has an inner end which extends to one of the center sections 36*a* or 36*b***.

The spring collapses to the position shown in broken lines in FIG. 3 in response to the application of a downward force to its upper portion. When this occurs, the base remains substantially horizontal, the inclinations of the connector bars 30 and 34 change so that their inclinations relative to the horizontal decrease. The horizontal bars 32 and 38 and, to a lesser extent, the bars 26 are subjected to torsional stresses within their elastic limits. When the upper portion of the spring of the attached grid moves downwardly to a limit position, the grid crosswire which is cornected to and bridges between the center sections **36*a* and 36*b* contacts the torsion bars 32** to limit the deflection of the spring.

Figure 4:
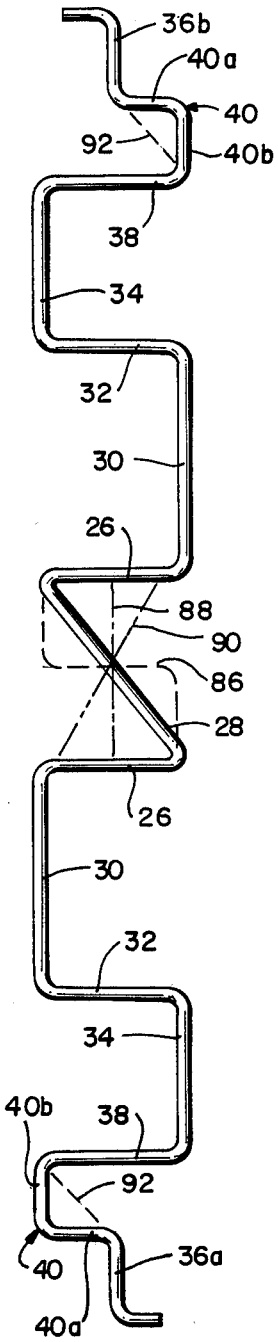
FIG. 4 shows the fabric used for forming the main spring illustrated in FIGS. 1–3.

Spring 6 and the other springs described in this specification are preferably formed of 8½ gauge sinuous wire, grade 1065 spring wire, having a diameter of 0.155 inch. Using conventional techniques, the wires are first bent into a two dimensional fabric. The fabric for forming the spring of FIGS. 1–3 is shown in FIG. 4. Then the appropriate transverse bars are twisted beyond their elastic limits to give the spring its three dimensional shape. In the case of the fabric of FIG. 4, the bars 26, 32 and 38 are twisted. Then, the spring is heated to a temperature of about 550° F. to relieve the internal stresses in the spring wire.

Figure 5:
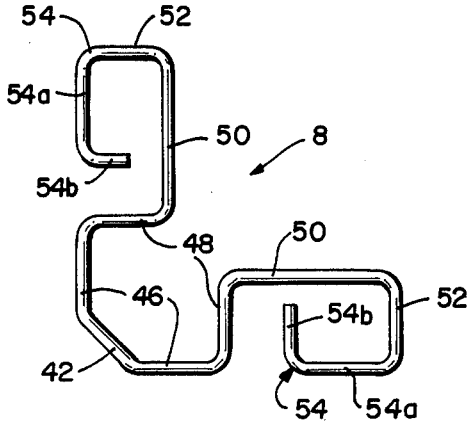
FIGS. 5 and 6 are top and side views, respectively of the corner spring shown in FIG. 1.
Figure 6:
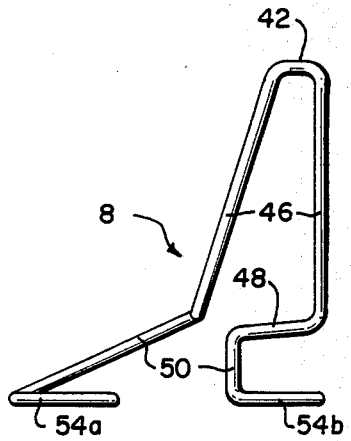

The corner spring 8 supports a corner of the wire grid 2 resiliently on the frame 4. Referring to FIGS. 1, 5 and 6, it will be seen that the corner spring 8 is formed of a single piece of resilient wire which has, at its upper end, a horizontal attachment portion 42 which is attached by a clip 44 to a corner of the wire grid. A pair of inclined upper connector bars 46 extend downwardly in diverging directions from the opposite ends of the attachment portion 42. These connector bars 46 are located in mutually perpendicular vertical planes which are parallel to the side and end rails of the frame 4. A pair of upper torsion bars 48 each have an outer end which extends from the lower end of one of the connector bars 46, and an inner end which extends to the upper end of one of two lower connector bars 50. The base of the spring 8 includes a pair of spaced apart feet, each of which includes a lower torsion bar 52 which has an inner end extending from the lower end of one of the connector bars 50. The outer end of the lower torsion bar is attached to an L-shaped section 54 formed of two legs **54*a* and 54*b* When the lower torsion bar 52 is attached to the frame by staples 56 as shown in FIG. 1, the staples 56 and the section 54 cooperate to mount the outer end of the torsion bar 52** nonrotatably on the frame.

As can be seen in FIG. 6, the upper connector bars 46 have a greater inclination from the horizontal than the lower bars 50. When the corner spring 8 is deformed to a collapsed position, the torsion bars 48 move downwardly until they contact the frame 4. This contact prevents any further deflection of the spring 8.

Figure 7:
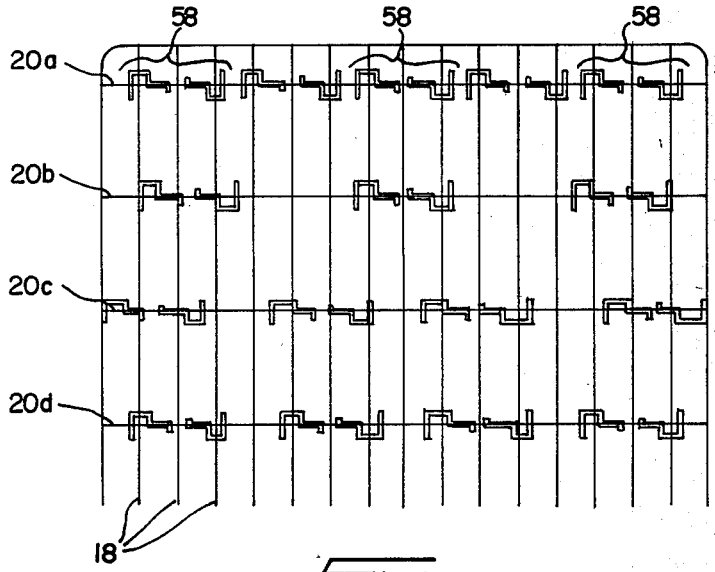
FIG. 7 is a diagram which shows various positionings of the main springs on the wire grid.

The versatility of positioning these springs is illustrated in the diagram of FIG. 7 which is a top view showing only the grid and the upper portions of the respective springs, the latter being identified by the reference numeral 58. In this diagram, it will be seen that the designer is provided with many choices as to the longitudinal position of the springs along a respective crosswire. Unlike previous formed wire box spring systems, it is not necessary to locate the spring at a grid intersection or in a particular relationship to one of the longwires. In FIG. 7, in the row of springs attached to grid wire 20*a*, five springs have been used, and these are positioned so that the longitudinal legs of the connecting portions are in vertical alignment with the longwires of the grid. Only three springs are attached to the crosswire 20*b*, and some of these are arranged so that their connecting sections underlie the longwires 18 and others are out of alignment with the longwires. The crosswire 20*c* is connected to four springs, the outermost of these having their outer transverse bars located beside the border wire where clips may be attached if desired. The next crosswire 20*d* has four equally spaced springs, all of which are positioned so that the longitudinal legs of their connecting sections lie beneath the longwires. In this arrangement, it will be noted that when the grid is moved downwardly toward the spring, there will be six points of contact between the grid and the spring. Two points of contact are at the connecting clips on the center bars; two contact points are between the longitudinal legs of the connecting sections and two of the longwires; and, two of the contact points are between the transverse bars and the crosswire to which the spring is clipped. This arrangement makes it possible to reduce the number of springs in the unit, inasmuch as each spring effectively supports a substantial area of the wire grid.

Figure 8:
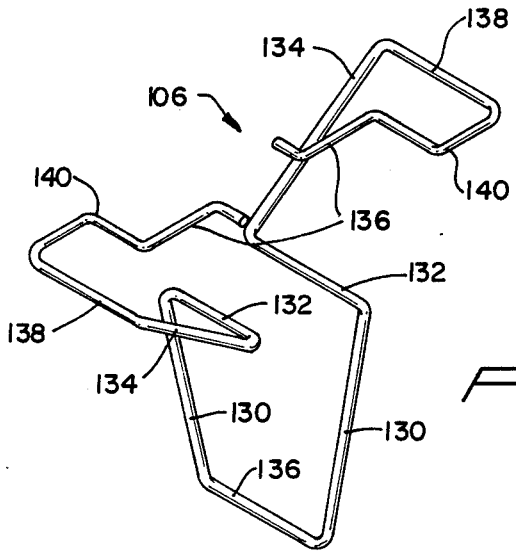
FIG. 8 is a perspective view of an alternative form of main spring which may be used together with or in lieu of the main springs shown in FIG. 1.
Figure 9:
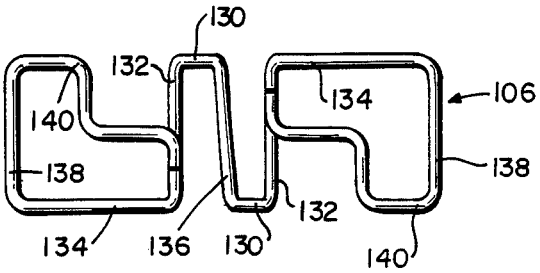
FIGS. 9 and 10 are top and front views, respectively, of the spring of FIG. 8; and, FIG. 11 is a view of a fabric used for manufacturing this spring.
Figure 10:
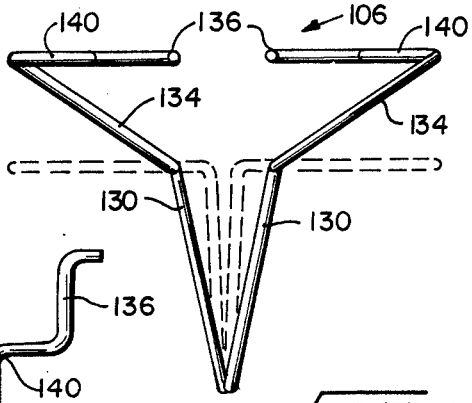
Figure 11:
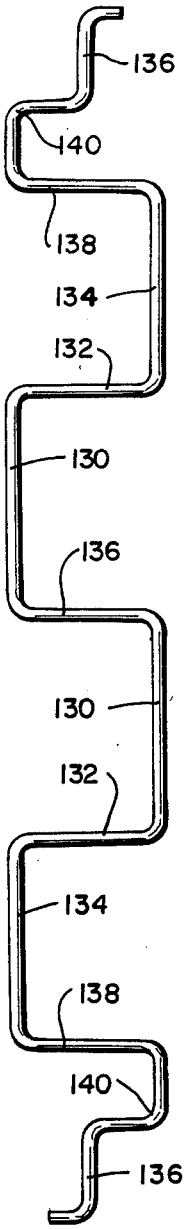

The spring 106 illustrated in FIGS. 8–10 may be used in addition to or in lieu of the main springs 6 described above. The spring 106 is desirable from the standpoint of economy inasmuch as it utilizes less spring wire than the other versions of the invention. The upper portion of spring 106 is essentially the same as the upper portion of the spring 6. It has a longitudinally oriented center bar 136, a pair of transverse bars 138, and a pair of connecting sections 140 which extend from one end of the center bar 136 to one end of a transverse bar 138. The opposite ends of the center bar 136 are directed toward the midportions of the transverse bars 138. The vertically collapsible midportion of the spring includes a pair of parallel horizontal torsion bars 132 which have lower and upper connector bars, 130 and 134 respectively, extending from their opposite ends. The base of this particular spring is only a single linear bar 126 which will be connected to the rails of the frame 4 by a pair of staples. This spring 106, like the previously-described spring 6, may be described as an "open top" spring because its upper portion is formed of two sections, each of which terminates in one end of the spring wire. The base portions of the springs 6 and 106 are continuous and uninterrupted.

A third type of main spring suitable for use in connection with the invention is illustrated at 206 in FIGS. 12–15. This spring differs from the previously described embodiments in the respect that the center bar is a straight wire section which is formed integral with both of the connecting wire sections. Spring 206 has a closed top, i.e. an upper portion which is continuous and uninterrupted. Its base portion is formed of two sections, each of which terminates in one end of the spring wire.

Figure 12:
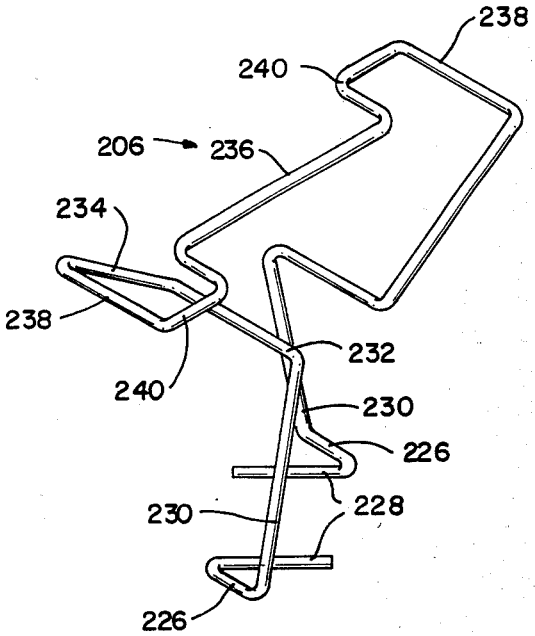
FIG. 12 is a perspective view of a second alternative form of main spring which may be used together with or in lieu of the main springs shown in FIG. 1.

Referring to FIG. 12, it will be seen that the center bar 236 has its opposite ends connected to two transverse torsion bars 238 by connecting sections 240. As in the previous embodiments, the opposite ends of the center bar 236 are directed toward the midportions of the torsion bars 238. The vertically collapsible midportion of the spring includes two torsion bars 232 which have connecting bars 230 and 234 extending downwardly and upwardly from their opposite ends. The base of this spring includes a spaced pair of V-shaped feet formed by the horizontal angularly related legs 226 and 228.

Figure 14:
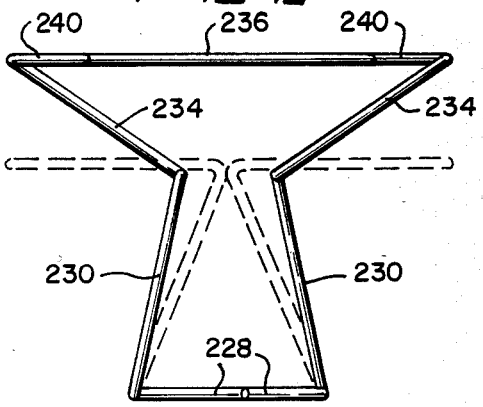

When the spring 206 is compressed to its maximum deflection condition shown in broken lines in FIG. 14, the center bar 236 comes into contact with the torsion bars 232 to prevent further deflection of the spring. This differs from the springs 6 and 106 of FIGS. 1 and 8 in the respect that the previously described embodiments reach their limit position when a wire of the grid, not a portion of the spring wire itself, comes into contact with the torsion bars of the midportion of the spring.

The main springs 6, 106 and 206 may have a height of about 5½ inches, a width of about 2⅜ inches and a length of about 7 inches measured longitudinally between the torsion bars of the upper portion. The upper connector bars of the midportion may be inclined about 34° from the horizontal, and the lower connector bars of the midportion may be inclined about 73° to 79° from the horizontal.

From the disclosure of FIGS. 1–4 and 7–16 it will be appreciated that the springs 6, 106 and 206 are quite effective in providing support to a relatively large area of the welded wire grid 2. This support is initially provided at the two locations of the attachment clips 24. When a downward force is applied to the grid, four additional points on the grid will move into contact with the spring to provide supplemental support. Two of these additional points are where the grid crosswire passes over the torsion bars in the upper portion of the spring, and the other two of these additional points of support are where two different longwires of the grid pass over the longitudinal legs of the connecting sections of the spring. To realize the benefits of the two latter points of contact in standard wire grids where the longwires are spaced apart about 2¾ inches, the torsion bars 38 of the spring should be spaced apart at least about 5½ inches.

Although it is possible to attach the center bars 36, 136 or 236 of the springs to the longwires 18 of the wire grid 2, it is preferable to attach them to the crosswires 20 as illustrated. Since the crosswires 20 are subjected to the greatest direct load, it is possible to reduce the diameter of the longwires 18 so that the crosswires 20 have a greater diameter and a greater stiffness than the longwires 18 as shown in FIG. 16. By way of example, the crosswires may be 13 gauge wires and the longwires may be 9 gauge wires. A benefit resulting from this arrangement, in contrast to one in which the longwires have the same or a larger diameter than the crosswires, is that the overall weight of the wire grid assembly is reduced. This, of course, is because the crosswires are fewer in number and shorter in length than the longwires. The weight reduction inherently results in a cost reduction.

In the course of fabricating springs, it has been found that the various legs of the horizontal upper portion are somewhat deformed from their intended positions and actually are slightly inclined as shown with some exaggeration in FIG. 16. In view of this configuration, it is desirable to position the grid at the orientation shown in FIG. 16 so that the longwires 18 are positioned below the crosswires 20. Due to this disposition, when the grid moves downwardly in the vicinity of the spring, the longwires move more quickly into contact with the longitudinal legs 40*a* of the upper portion of the spring.

In lieu of the corner spring 8 shown in FIGS. 1, 5 and 6, the invention also contemplates the use of a stop member which is operable to prevent the inward sagging of the cotton filler material, and to limit the deflection of adjacent springs by limiting the movement of the grid assembly toward the frame assembly. The stop member may limit the movement to zero movement or to a predetermined distance, for example one inch. An example of the former is illustrated at 60 in FIGS. 17–19 and an example of the latter is shown at 72 in FIGS. 20–22.

Referring to FIGS. 17–19, it will be seen that the corner piece 60 includes four vertical bars 62 which are connected together at their upper ends by an upper set of connector bars 64 and are connected together at their lower ends by a lower set of connector bars 66. The upper connector bars 64 are angularly disposed relative to each other in a common horizontal plane, as are the lower connector bars 66. The vertical bars 62 and the upper bars 64 form two vertical loops which are substantially uncompressible in a vertical direction. The opposite ends of each of these loops extend to two of the lower horizontal bars 66. Staples 68 connect the lower horizontal bars 66 to the frame, and clips 70 connect the upper horizontal bars 64 to the corner of the wire grid. It will be apparent that the corner piece may be inverted if desired, but this would add to the expense of the unit because clips are more expensive than staples.

While the corner piece 60 shown in FIGS. 17–19 limits the movement of the grid assembly toward the frame assembly to zero movement, the corner piece 72 of FIGS. 20–22 permits some downward movement of the corner of the grid. Referring to FIG. 20, it will be seen that the upper end of the corner piece 72 has two horizontal bars 74 which lie in a common plane and are angularly disposed relative to each other in this plane. A substantially uncompressible vertical loop is formed by two vertical bars 76 and a lower horizontal bar 78, the latter being spaced a small distance such as approximately one inch above the upper surface of the frame assembly. The upper horizonal bars 74 are held by clips 80 to the border wire of the grid assembly.

It will be apparent that the pieces 60 and 72 shown in FIGS. 17–22 may be modified in many ways and that they may be positioned at locations other than at the corners of the bedding unit. For example, the device 68 in FIG. 17 may be inverted and may have its vertical bars 62 foreshortened and unattached to the frame assembly so that it permits some downward movement of the corner of the border wire. The device 72 of FIG. 20 may be modified so that its upper horizontal bars 74 are perpendicular to each other so that they may be clipped to the longwires and crosswires of the grid near a grid intersection. One bar 74 may lie against against the bottom of a crosswire 20, and the other bar 74 may lie against the side of a longwire 18. The lower horizontal bar 70 is vertically aligned with a cross rail 14 of the frame, the stop member would be operable to permit only a predetermined amount of downward movement of the grid intersection when a downward force is applied to the grid.

Figure 23:
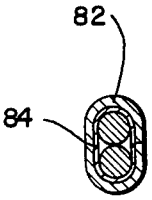
FIG. 23 is a sectional view showing the attachment of two wires together by means of a clip which is internally coated with a yieldable plastic material.
Figure 13:
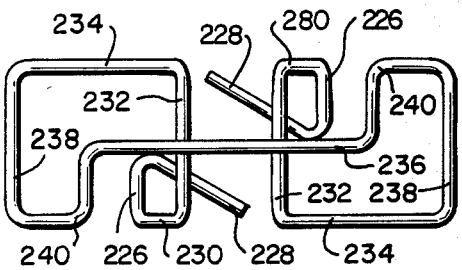
FIGS. 13 and 14 are top and front views, respectively, of the spring of FIG. 12; and, FIG. 15 is a view of a fabric used for manufacturing this spring.

The clips 24, 44, 70 and 80 may be of generally conventional construction. However, in a modified version of the invention, a clip 82 is constructed as shown in FIG. 23, having been provided on its interior surfaces with a coating 84 of yieldable plastic material which contacts the spring wire and the grid wire to reduce the noise in the bedding unit. The coating preferably has a high coefficient of friction in order to deter lengthwise slipping movement of the wires in the clip. The plastic material may be a vinyl composition, polyurethane or any other suitable elastomer. Suitable compositions of the plastic material are disclosed in U.S. Pat. No. 3,977,029 which is incorporated herein by reference. Plastic coatings have previously been applied to grid wires and to springs, but these earlier measures have required far more plastic material than is needed than if the coating is applied only to the clip as shown in FIG. 23. Some previous clips have been provided with paper linings, but these have not alleviated the problem of longitudinal slippage between the clip and the clipped wires.

It will be appreciated that only the preferred embodiments of the invention have been disclosed. Many modifications thereto may be made without departing from the spirit of the invention. For example, the main springs may be turned so that their center bars are clipped in parallel relation to the longwires 18 of the wire grid. This may require larger diameter longwires, thereby increasing the weight of the unit and adding to the expense of materials. The transverse bars 38, 138 or 238 may be clipped to any of the wires of the grid, including the border wire. Similarly, the longitudinal legs of the connecting sections 40, 140 or 240 may be clipped to any of the wires of the grid.

The configurations of the main springs may also be varied considerably. For example, the main spring 6 may be provided with bases of several different configurations, examples of these being shown schematically by the broken lines 86, 88 and 90 in FIG. 4. The upper portions of the main springs may be modified, for example, by replacing the legs **40*a* and 40*b* with a single diagonally extending leg such as shown by the broken line 92 in FIG. 4. The feet of the closed-top spring shown in FIG. 12 may take many forms as, for example, a U-shaped configuration similar to that used in the corner spring 8**. In view of these and other possible modifications, it is emphasized that the invention is not limited only to the disclosed embodiments but is embracing of variations thereof and modifications thereto which fall within the spirit of the following claims.

I claim:

1. A spring for supporting a wire grid on a frame of a bedding unit, said spring being formed of a single resilient wire which has a lower portion connectible to the frame, an upper portion connectible to the wire grid, and a midportion connecting the lower portion to the upper portion, said midportion being vertically collapsible to support the upper portion resiliently on the lower portion, said upper portion being substantially horizontal and including a longitudinally oriented center bar and a pair of transverse bars, said center bar being formed of two sections which are at opposite ends of said single resilient wire, said center bar being spaced from and located between said transverse bars at a position where the opposite ends of the center bar are directed toward midportions of the transverse bars, said upper portion also having a pair of connecting sections each of which extends from one end of the center bar to one end of a transverse bar.

2. A spring according to claim 1 wherein the transverse bars are torsion bars, said midportion including torsion bars and connector bars, said connector bars connecting the torsion bars of the midportion to the lower portion and to the transverse torsion bars of the upper portion.

3. A spring according to claim 2 wherein the midportion is vertically collapsible to a compressed position where the center bar of the upper portion is in contact with the torsion bars of the midportion to limit the deflection of the spring.

4. A spring according to claim 2 wherein the center bar lies in a vertical plane which intersects said torsion bars of the midportion, said center bar of the upper portion and said torsion bar of the midportion being relatively movable, when the midportion collapses, from a spaced apart relationship to a mutually contacting relationship in order to limit the deflection of the spring.

5. A spring according to claim 2 wherein the lower portion consists of a continuous and uninterrupted lower bar which extends between two connector bars of the midportion.

6. A spring according to claim 5 wherein said two connector bars of the midportion are upwardly divergent.

7. A spring according to claim 1 wherein, in the upper portion, each transverse bar and the connecting section connected thereto form a hook-shaped configuration.

8. A spring according to claim 1 wherein each connecting section is L-shaped and includes a longitudinal bar which is positionable in underlying relation to a wire of the grid.

9. A spring according to claim 1 in combination with a wire grid, a frame, and a plurality of said springs: said springs having their lower portions connected to the frame and their upper portions connected to the wire grid to form a bedding unit.

10. A bedding unit according to claim 9 wherein the frame includes a plurality of parallel crossrails which extend from side-to-side of the bedding unit, and the wire grid is formed of a plurality of longwires intersecting a plurality of crosswires, said crosswires of the wire grid lying in vertical alignment with the crossrails of the frame, at least some of said springs having their center bars connected to the crosswires.

11. A bedding unit according to claim 10 wherein the midportion of the spring includes torsion bars and connector bars, said connector bars connecting the torsion bars of the midportion to the lower portion and to the transverse bars of the upper portion, said grid being downwardly movable, when the midportion of the spring collapses, to a position where a wire of the grid contacts a torsion bar of the midportion of the spring to limit the deflection of the spring.

12. A bedding unit according to claim 10 wherein the crosswires are stiffer than the longwires.

13. A bedding unit according to claim 10 wherein the crosswires have a greater diameter than the longwires.

14. A bedding unit according to claim 10 wherein the crosswires extend over the longwires.

15. A bedding unit such as a box spring, comprising a frame, a wire grid spaced above said frame, and a plurality of springs resiliently supporting said grid on said frame, at least one of said springs being formed of a single resilient wire which has a lower portion connected to the frame, an upper portion connected to the grid, and a midportion connecting the lower portion to the upper portion, said midportion being vertically collapsible to support the upper portion resiliently on the lower portion, said upper portion being substantially horizontal and including a longitudinally oriented center bar and a transverse bar, said center bar being spaced from said transverse bar at a postion where the axis of the center bar is directed toward the midportion of the transverse bar, said upper portion also having a connecting section which extends from one end of the center bar to an end of the transverse bar, said frame including a plurality of parallel crossrails which extend from side-to-side of the bedding unit, said wire grid being formed of a plurality of longwires intersecting a plurality of crosswires, said crosswires of the wire grid lying in vertical alignment with the crossrails of the frame, a plurality of said crosswires each having the center bars of a plurality of said springs connected thereto, whereby different units may have different spacings between the springs without changing the spacings between the longwires.

16. A bedding unit according to claim 15 wherein the transverse bar is a torsion bar, said midportion including a torsion bar and connector bars, said connector bars connecting the torsion bar of the midportion to the lower portion and to the transverse torsion bar of the upper portion.

17. A bedding unit according to claim 16 wherein the midportion is vertically collapsible to a compressed position where the center bar of the upper portion is in contact with the torsion bar of the midportion to limit the deflection of the spring.

18. A bedding unit according to claim 16 wherein the wire grid has a wire which is downwardly movable, when the midportion of the spring is collapsed, to a position where said grid wire contacts a torsion bar of the midportion to limit the deflection of the spring.

19. A bedding unit according to claim 15 wherein, in the upper portion, the transverse bar and the connecting section connected thereto form a hook-shaped configuration.

20. A bedding unit according to claim 15 wherein the connecting section is L-shaped and includes a longitudinal bar which is positioned in underlying relation to a wire of the grid.

21. A bedding unit according to claim 15 wherein the upper portion has two said transverse bars and two said connecting sections, said transverse bars being longitudinally spaced in opposite directions from said center bar, said connecting sections extending from opposite ends of said center bar.

22. A bedding unit according to claim 21 wherein the midportion includes torsion bars and connector bars, said connector bars connecting the torsion bars of the midportion to the lower portion and to the transverse bars of the upper portion.

23. A bedding unit according to claim 15 wherein the lower portion consists of a continuous and uninterrupted lower bar which extends between two connector bars of the midportion.

24. A bedding unit according to claim 23 wherein said two connector bars of the midportion are upwardly divergent.

25. A bedding unit according to claim 15 wherein the frame includes a plurality of parallel crossrails which extend from side-to-side of the bedding unit, and the wire grid is formed of a plurality of longwires intersecting a plurality of crosswires, said crosswires of the wire grid lying in vertical alignment with the crossrails of the frame, at least some of said springs having their center bars connected to the crosswires.

26. A bedding unit according to claim 25 wherein the crosswires are stiffer than the longwires.

27. A bedding unit according to claim 25 wherein the crosswires have a greater diameter than the longwires.

28. A bedding unit according to claim 25 wherein the crosswires extend over the longwires.

29. A bedding unit comprising a frame assembly, a wire grid assembly spaced above said frame, a plurality of springs resiliently supporting said grid assembly on said frame assembly, and a stop member for limiting the movement of the grid assembly toward the frame assembly to limit the deflection of the springs, said stop member having at one end thereof a plurality of horizontal bars which are spaced from each other, said horizontal bars lying in a common horizontal plane and being angularly disposed relative to each other in said horizontal plane, a vertical loop which is substantially uncompressible in a vertical direction and has opposite ends which extend to two of said bars, and means for connecting said horizontal bars to one of said assemblies, said vertical loop being spaced from the other one of said assemblies, said vertical loop being in vertical alignment with a portion of the other said assembly so that collapsing movement between said assemblies will bring the loop into contact with the other said assembly to limit the collapsing movement of said bedding unit.

30. A bedding unit according to claim 29 wherein said wire grid assembly has a corner which is connected to the horizontal bars of the stop member.

31. A bedding unit according to claim 30 wherein the vertical loop is attached to the frame assembly.

32. A bedding unit comprising a frame, a wire grid spaced above the frame, and a spring which resiliently supports said wire grid on said frame, said spring being formed of a single resilient wire which has a lower portion connected to the frame, an upper portion connected to the wire grid, and a midportion connecting the lower portion of the spring to the upper portion of the spring, said midportion being vertically collapsible to support the upper portion resiliently on the lower portion, said single resilient wire having opposite ends which are located in said upper portion of the spring, said midportion of the spring having two vertically collapsible portions which extend downwardly to said lower portion from opposite ends of said upper portion, said lower portion being a continuous and uninterrupted portion each end of which extends to one of the vertically collapsible portions of the midportion.

33. A bedding unit to claim 32 wherein the upper portion includes a pair of transverse bars which are horizontally spaced from each other, each of said vertically collapsible portions of the midportion including a torsion bar, an upper connector bar and a lower connector bar, said lower connector bars extending from the lower portion of the spring to the torsion bars, said upper connector bars extending from the torsion bars to the transverse bars of the spring.

34. A bedding unit according to claim 33 wherein the lower connector bars are upwardly divergent.

35. A bedding unit according to claim 33 wherein the base consists of a single bar.

36. A bedding unit according to claim 33 wherein the frame includes crossrails which extend from side-to-side of the bedding unit, and the wire grid is formed of a plurality of longwires intersecting a plurality of crosswires, said crosswires of the wire grid lying in vertical alignment with the crossrails of the frame.

37. A bedding unit according to claim 36 wherein the crosswires are stiffer than the longwires.

38. A bedding unit according to claim 36 wherein the crosswires have a greater diameter than the longwires.

39. A bedding unit according to claim 36 wherein the crosswires extend over the longwires.

40. A bedding unit comprising a frame, a wire grid spaced above said frame, and a plurality of springs resiliently supporting said grid on said frame, said wire grid having corners, a corner spring formed of a single resilient wire, said corner spring having an upper attachment portion connected to a corner of said wire grid, a pair of inclined upper connector bars extending downwardly in diverging directions from opposite ends of said attachment portion, a pair of upper torsion bars each having an end extending to the lower end of one of the upper connector bars, a pair of inclined lower connector bars each having an upper end extending to an end of one of the upper torsion bars, a pair of lower torsion bars each having one end nonrotatably mounted on the frame and another end extending to the lower end of one of the lower connector bars, said corner spring being vertically collapsible to support the corner of the grid on the frame.

41. A bedding unit according to claim 40 wherein the upper connector bars have a greater inclination from the horizontal than the lower connector bars.

42. A bedding unit according to claim 40 wherein the spring is deformable to a collapsed position where the upper torsion bars contact the frame to limit the deflection of the spring.

43. A bedding unit such as a box spring, comprising, a frame, a wire grid spaced above said frame, and a plurality of springs resiliently supporting said grid on said frame, at least one of said springs being formed of a single resilient wire which has a lower portion connected to the frame, an upper portion connected to the wire grid, and a midportion connecting the lower portion to the upper portion, said midportion being vertically collapsible to support the upper portion resiliently on the lower portion, said upper portion being substantially horizontal, said midportion comprising two spaced apart collapsible sections extending between the upper and lower portions of the spring, each of said collapsible sections of the midportion including only one torsion bar and only two connector bars which are connected to said torsion bar, one of said connector bars in each collapsible section connecting said torsion bar to the upper portion of the spring, said upper portion of the spring and the grid attached thereto normally being higher than said torsion bar, said upper portion of the spring and the grid being downwardly movable, when the midportion of the spring is collapsed, to a position where one of said grid and said upper portion of the spring contacts said torsion bar to limit the deflection of the spring, one of said connector bars being operable to hold said torsion bar above said frame when the torsion bar contacts one of said grid and said upper portion of the spring.

44. A bedding unit according to claim 43 wherein the upper portion includes a bar which lies in a vertical plane which intersects said torsion bar so that said mutual contacting relationship is between said torsion bar and the bar of the upper portion of the spring.

45. A bedding unit according to claim 44 wherein said vertical plane substantially bisects said torsion bar.

46. A bedding unit according to claim 43 wherein the frame includes a plurality of parallel crossrails which extend from side-to-side of the bedding unit, and the wire grid is formed of a plurality of longwires intersecting a plurality of crosswires, said crosswires of the wire grid lying in vertical alignment with the crossrails of the frame, said springs having center bars which are connected to the crosswires.

47. A bedding unit according to claim 46 wherein the crosswires are stiffer than the longwires.

48. A bedding unit according to claim 46 wherein the crosswires have a greater diameter than the longwires.

49. A bedding unit according to claim 46 wherein the crosswires extend over the longwires.

50. A spring for supporting a wire grid on a frame of a bedding unit, said spring being formed of a single resilient wire which has a lower portion connectible to the frame, an upper portion connectible to the wire grid, and a midportion connecting the lower portion to the upper portion, said midportion including torsion bars and connector bars and being vertically collapsible to support the upper portion resiliently on the lower portion, said upper portion being substantially horizontal and including a longitudinally oriented center bar and a pair of transverse torsion bars, said connector bars connecting the torsion bars of the midportion to the lower portion and to the transverse torsion bars of the upper portion, said lower portion consisting of a continuous and uninterrupted lower bar which extends between two connector bars of the midportion, said center bar being spaced from and located between said transverse bars at a postion where the opposite ends of the center bar are directed toward midportions of the transverse bars, said upper portion also having a pair of connecting sections each of which extends from one end of the center bar to one end of a transverse bar.

51. A spring according to claim 50 wherein said two connector bars of the midportion are upwardly divergent.

52. A bedding unit such as a box spring, comprising a frame, a wire grid spaced above said frame, and a plurality of springs resiliently supporting said grid on said frame, at least one of said springs being formed of a single resilient wire which has a lower portion connected to the frame, an upper portion connected to the grid, and a midportion connecting the lower portion to the upper portion, said midportion having at least two connector bars and being vertically collapsible to support the upper portion resiliently on the lower portion, said lower portion consisting of a continuous and uninterrupted lower bar which extends between two connector bars of the midportion, said upper portion being substantially horizontal and including a longitudinally oriented center bar and a transverse bar, said center bar being spaced from said transverse bar at a position where the axis of the center bar is directed toward the midportion of the transverse bar, said uppoer portion also having a connecting section which extends from one end of the center bar to an end of the transverse bar.

53. A bedding unit according to claim 52 wherein said two connector bars of the midportion are upwardly divergent.

* * * * *